US010210835B2

(12) United States Patent
Han et al.

(10) Patent No.: US 10,210,835 B2
(45) Date of Patent: Feb. 19, 2019

(54) GATE DRIVER ON ARRAY CIRCUIT AND DRIVING METHOD THEREOF, AND DISPLAY DEVICE

(71) Applicant: BOE TECHNOLOGY GROUP CO., LTD., Beijing (CN)

(72) Inventors: Mingfu Han, Beijing (CN); Guangliang Shang, Beijing (CN); Seungwoo Han, Beijing (CN); Zhihe Jin, Beijing (CN); Xing Yao, Beijing (CN); Haoliang Zheng, Beijing (CN); Lijun Yuan, Beijing (CN); Zhichong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/656,419

(22) Filed: Jul. 21, 2017

(65) Prior Publication Data

US 2018/0025695 A1 Jan. 25, 2018

(30) Foreign Application Priority Data

Jul. 22, 2016 (CN) ..... 2016 1 0587269

(51) Int. Cl.
*G09G 3/36* (2006.01)
*G09G 3/30* (2006.01)

(52) U.S. Cl.
CPC ... *G09G 3/3677* (2013.01); *G09G 2300/0408* (2013.01); *G09G 2310/0286* (2013.01); *G09G 2310/08* (2013.01); *G09G 2330/08* (2013.01)

(58) Field of Classification Search
CPC ..... G09G 2330/12; G09G 3/3611–3/3692; G09G 2310/00–2310/08
See application file for complete search history.

(56) References Cited

U.S. PATENT DOCUMENTS 5,815,129 A * 9/1998 Jung ..... G09G 3/3677 345/100
5,859,627 A * 1/1999 Hoshiya ..... G09G 3/3688 345/100

(Continued)

FOREIGN PATENT DOCUMENTS

CN 103426385 A 12/2013
CN 105096876 A 11/2015
CN 105427830 A 3/2016

OTHER PUBLICATIONS

Chinese office action dated Dec. 28, 2017 for corresponding CN application No. 201610587269.3 with English translation.

*Primary Examiner* — Sanghyuk Park
(74) *Attorney, Agent, or Firm* — Nath, Goldberg & Meyer; Joshua B. Goldberg; Daniel Bissing

(57) ABSTRACT

The present invention discloses a gate driver on array circuit and a driving method thereof, and a display device. The gate driver on array circuit comprises a first gate driver on array sub-circuit and a second gate driver on array sub-circuit; the first gate driver on array sub-circuit is configured to drive in a first working state which is a state in which no defect occurs in the first gate driver on array sub-circuit; the second gate driver on array sub-circuit is configured to drive in a second working state which is a state in which a defect occurs in the first gate driver on array sub-circuit. The present invention improves the yield rate of the gate driver on array circuit.

10 Claims, 7 Drawing Sheets

(56) References Cited

U.S. PATENT DOCUMENTS

| | | | | |
|---|---|---|---|---|
| 6,467,057 | B1 | 10/2002 | Wang et al. | |
| 2011/0148825 | A1* | 6/2011 | Ueno | G09G 3/006 345/204 |
| 2011/0193831 | A1* | 8/2011 | Kunimori | G11C 19/184 345/204 |

* cited by examiner

GATE DRIVER ON ARRAY CIRCUIT AND DRIVING METHOD THEREOF, AND DISPLAY DEVICE

CROSS-REFERENCE TO RELATED APPLICATION

This PCT patent application claims priority of Chinese Patent Application No. 201610587269.3, filed on Jul. 22, 2016, the entire content of which is incorporated by reference herein.

TECHNICAL FIELD

The present invention relates to the field of display technology, more particularly, to a gate driver on array circuit and a driving method thereof, and a display device.

BACKGROUND

With the widespread use of liquid crystal display devices in life, high resolution and narrow bezel has become a development trend for liquid crystal display devices currently. Driving technologies of liquid crystal display devices mainly include data driving technology and gate driving technology, wherein the gate driving technology may enable the liquid crystal display device to display with high resolution and narrow bezel.

A Gate Driver on Array (GOA) circuit is a significant component for the gate driving technology. The GOA circuit may include a plurality of cascaded shift registers, each shift register being connected with one gate line to which a signal is applied by the GOA circuit so as to realize progressive scanning for pixels. As compared with conventional design, the GOA circuit can reduce the cost of the liquid crystal display device while reducing the number of procedures and raising production.

In the prior art, the GOA circuit has a low yield rate.

SUMMARY

The present disclosure provides a GOA circuit and a driving method thereof, and a display device which can improve the yield rate of the GOA circuit.

In order to achieve at least the above object, the present disclosure provides a gate driver on array circuit comprising a first gate driver on array sub-circuit and a second gate driver on array sub-circuit;

the first gate driver on array sub-circuit is configured to drive gate lines in a first working state, wherein the first working state is a state in which no defect occurs in the first gate driver on array sub-circuit; and the second gate driver on array sub-circuit is configured to drive the gate lines in a second working state, wherein the second working state is a state in which a defect occurs in the first gate driver on array sub-circuit.

Optionally, the first working state is a state in which no defect occurs in the first gate driver on array sub-circuit, and the second working state is a state in which a defect occurs in the first gate driver on array sub-circuit;

the first gate driver on array sub-circuit is configured to perform driving when no defect occurs therein and to stop driving when a defect occurs therein; and the second gate driver on array sub-circuit is configured to perform driving when the first gate driver on array sub-circuit stops driving due to occurrence of a defect in the first gate driver on array sub-circuit.

Optionally, the first gate driver on array sub-circuit and the second gate driver on array sub-circuit each include a plurality of cascaded shift registers, and output signal terminals of the shift registers in the first gate driver on array sub-circuit are connected to those of respective shift registers in the second gate driver on array sub-circuit.

Optionally, the first gate driver on array sub-circuit is configured to, in the first working state, cause high level signals to be applied respectively to clock signal terminals of the shift registers in the first gate driver on array sub-circuit and low level signals to be applied to other terminals of the shift registers in the first gate driver on array sub-circuit; or the first gate driver on array sub-circuit is configured to, in the first working state, cause clock signals to be applied respectively to the clock signal terminals of the shift registers in the first gate driver on array sub-circuit and low level signals to be applied to other terminals of the shift registers in the first gate driver on array sub-circuit.

Optionally, each of the shift registers includes a first transistor;

a control electrode of the first transistor is connected to an input signal terminal, a first electrode of the first transistor is connected to a first power supply, and a second electrode of the first transistor is connected to a pull-up node.

Optionally, the gate driver on array circuit further comprises a detection circuit and a switching circuit;

the detection circuit is configured to detect the first gate driver on array sub-circuit and, when a defect occurs in the first gate driver on array sub-circuit, generate an abnormal signal, generate a starting signal according to the abnormal signal and output the starting signal to the switching circuit;

the switching circuit is configured to be started according to the starting signal, and output a switching signal to the first gate driver on array sub-circuit and output the switching signal to the second gate driver on array sub-circuit;

the first gate driver on array sub-circuit is configured to stop driving according to the switching signal;

the second gate driver on array sub-circuit is configured to drive according to the switching signal.

Optionally, the first gate driver on array sub-circuit and the second gate driver on array sub-circuit each include a plurality of cascaded shift registers, output signal terminals of the shift registers in the first gate driver on array sub-circuit are connected to those of respective shift registers in the second gate driver on array sub-circuit, and the output signal terminal of a last row of shift register in the first gate driver on array sub-circuit is connected to an input signal terminal of the detection circuit;

the switching circuit includes a plurality of cascaded shift registers, an input signal terminal of a first row of shift register of the switching circuit is connected to an output signal terminal of the detection circuit, an output signal terminal of a last row of shift register of the switching circuit is connected to an input signal terminal of a first row of shift register in the second gate driver on array sub-circuit, and the output signal terminal of the last row of shift register of the switching circuit is connected to a switching signal terminal of the first row of shift register in the first gate driver on array sub-circuit.

Optionally, the number of rows of the shift registers in the switching circuit is determined according to a blanking time between two frames of display images such that a timing of the switching signal output by the last row of shift register of the switching circuit is the same as that of a frame-start signal of the first row of shift register of the second gate driver on array sub-circuit.

Optionally, the first row of shift register of the first gate driver on array sub-circuit includes a switching transistor, a control electrode of the switching transistor is connected to the output signal terminal of the last row of shift register in the switching circuit, a first electrode of the switching transistor is connected to a pull-up node, and a second electrode of the switching transistor is connected to a low level signal terminal.

Optionally, the detection circuit is an inverter, the abnormal signal is a low level signal, and the starting signal is a high level signal.

In order to achieve at least the above object, the present invention provides a display device comprising the gate driver on array circuit as mentioned above.

In order to achieve at least the above object, the present invention provides a driving method for a gate driver on array circuit which comprises a first gate driver on array sub-circuit and a second gate driver on array sub-circuit;

the method comprises:

driving gate lines in a first working state by the first gate driver on array sub-circuit, wherein the first working state is a state in which no defect occurs in the first gate driver on array sub-circuit; and driving the gate lines in a second working state by the second gate driver on array sub-circuit, wherein the second working state is a state in which a defect occurs in the first gate driver on array sub-circuit.

Optionally, the first gate driver on array sub-circuit performs driving when no defect occurs therein and stops driving when a defect occurs therein;

the second gate driver on array sub-circuit performs driving when the first gate driver on array sub-circuit stops driving due to occurrence of a defect in the first gate driver on array sub-circuit.

Optionally, the gate driver on array circuit further comprises a detection circuit and a switching circuit;

before the second gate driver on array sub-circuit performs driving when the first gate driver on array sub-circuit stops driving due to occurrence of a defect in the first gate driver on array sub-circuit, the method further comprises:

detecting, by the detection circuit, the first gate driver on array sub-circuit and generating an abnormal signal when a defect occurs in the first gate driver on array sub-circuit, generating a starting signal according to the abnormal signal and outputting the starting signal to the switching circuit;

the switching circuit starting according to the starting signal, outputting a switching signal to the first gate driver on array sub-circuit and outputting the switching signal to the second gate driver on array sub-circuit;

the first gate driver on array sub-circuit stopping driving according to the switching signal; and wherein, the step that the second gate driver on array sub-circuit performs driving when the first gate driver on array sub-circuit stops driving due to occurrence of a defect comprises: the second gate driver on array sub-circuit performing driving according to the switching signal.

The present disclosure has beneficial effects as follows.

In the technical solutions of the gate driver on array circuit and the driving method thereof and the display device, the first gate driver on array sub-circuit performs driving in the first working state, and the second gate driver on array sub-circuit performs driving in the second working state, thereby improving the yield rate of the gate driver on array circuit.

DETAILED DESCRIPTION

In order that the technical solutions of the present invention may be appreciated well by a person skilled in the art, detailed description will be made below to the gate driver on array circuit and the driving method thereof and the display device provided by the present disclosure in conjunction with accompanying drawings.

Figure 1:
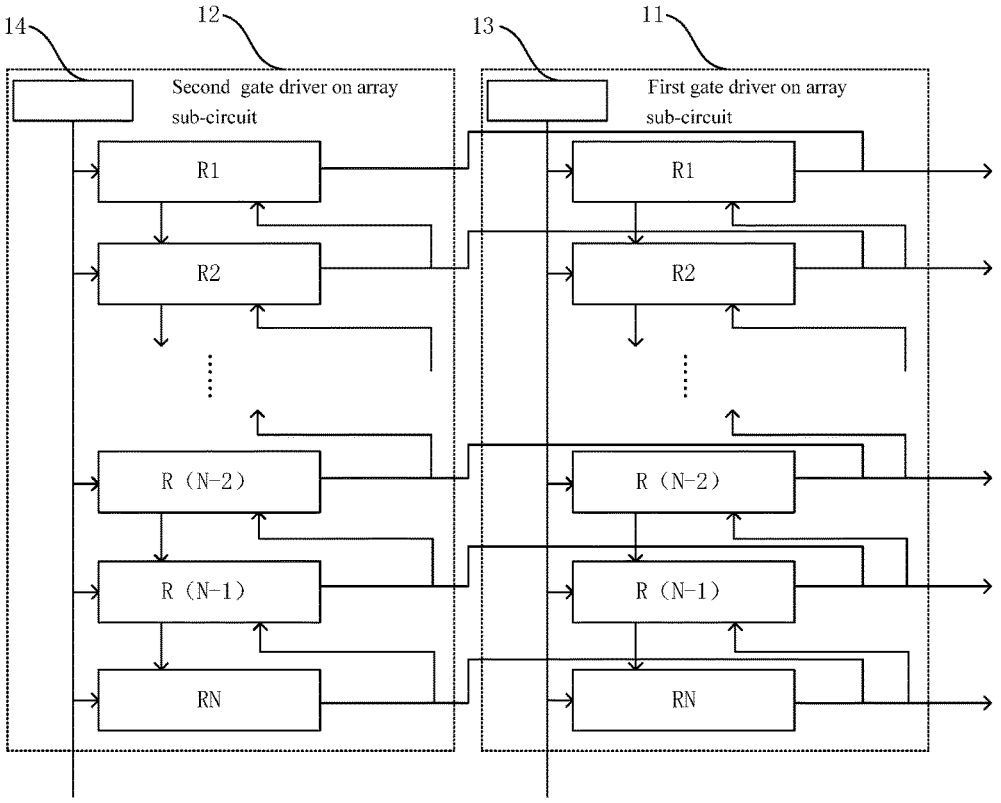
FIG. 1 is a schematic diagram of a structure of a gate driver on array circuit provided by Embodiment 1 of the present invention.

FIG. 1 is a schematic diagram of a structure of a gate driver on array circuit provided by Embodiment 1 of the present invention. As shown in FIG. 1, the gate driver on array circuit comprises a first gate driver on array sub-circuit 11 and a second gate driver on array sub-circuit 12. The first gate driver on array sub-circuit 11 is configured to drive gate lines in a first working state, wherein the first working state is a state in which no defect occurs in the first gate driver on array sub-circuit; the second gate driver on array sub-circuit 12 is configured to drive the gate lines in a second working state, wherein the second working state is a state in which a defect occurs in the first gate driver on array sub-circuit.

In the present embodiment, the gate driver on array circuit may work in the first working state or the second working state such that the first gate driver on array sub-circuit 11 performs driving when the gate driver on array circuit is in the first working state and the second gate driver on array sub-circuit 12 performs driving when the gate driver on array circuit is in the second working state, and thus the first gate driver on array sub-circuit 11 and the second gate driver on array sub-circuit 12 perform driving in different working states.

In the gate driver on array circuit provided by the present embodiment, the first gate driver on array sub-circuit 11 performs driving in the first working state and the second gate driver on array sub-circuit 12 performs driving in the second working state, thereby improving the yield rate of the gate driver on array circuit.

Preferably, the first working state is a state in which no defect occurs in the first gate driver on array sub-circuit 11, and the second working state is a state in which a defect occurs in the first gate driver on array sub-circuit 11. When the gate driver on array circuit is in the first working state, specifically, the first gate driver on array sub-circuit 11 is configured to perform driving in the case where no defect occurs in the first gate driver on array sub-circuit 11; when the gate driver on array circuit is in the second working state, specifically, the second gate driver on array sub-circuit 12 is configured to perform driving in the case where the first gate driver on array sub-circuit 11 stops driving due to occurrence of a defect.

In the present embodiment, in the first working state, the first gate driver on array sub-circuit 11 is a working gate driver on array sub-circuit while the second gate driver on array sub-circuit 12 is a standby gate driver on array sub-circuit, and the first gate driver on array sub-circuit 11 performs driving while the second gate driver on array sub-circuit 12 does not perform driving; in the second working state, the first gate driver on array sub-circuit 11 stops driving and the standby second gate driver on array sub-circuit 12 begins to drive.

After the manufacture of a display device provided with the gate driver on array circuit of the present embodiment is finished, it is required for the display device to be tested by an operator. In the testing of the display device by the operator, the gate driver on array circuit first performs driving by using the first gate driver on array sub-circuit 11. If the operator detects that the display device displays normally, it means that there is no defect occurring in the first gate driver on array sub-circuit 11, and the driving is continued by the first gate driver on array sub-circuit 11. If the operator detects a defect such as stripes displayed on the display device, it means that a defect occurs in the first gate driver on array sub-circuit 11, and in this case, the operator causes the first gate driver on array sub-circuit 11 to stop driving, switches it to the second gate driver on array sub-circuit 12 by manual operation, and cause the second gate driver on array sub-circuit 12 to perform driving.

In the present embodiment, the first gate driver on array sub-circuit 11 and the second gate driver on array sub-circuit 12 each include a plurality of cascaded shift registers. As shown in FIG. 1, the first gate driver on array sub-circuit 11 comprises a first row of shift register R1, a second row of shift register R2, . . . , an $N^{th}$ row of shift register RN, and the second gate driver on array sub-circuit 12 comprises a first row of shift register R1, a second row of shift register R2, . . . , an $N^{th}$ row of shift register RN. The first gate driver on array sub-circuit 11 further comprises a signal controller 13 configured to output control signals to each shift register. For example, the control signals may comprise a frame-start signal, a clock signal, etc., which will not be exhaustively listed here. The second gate driver on array sub-circuit 12 further comprises a signal controller 14 configured to output control signals to each shift register. For example, the control signal may comprise a frame-start signal, a clock signal, etc., which will not be exhaustively listed here. In the first gate driver on array sub-circuit 11, an input signal terminal of the first row of shift register R1 is inputted with the frame-start signal, and each of the input signal terminals of other rows of shift registers is connected to an output signal terminal of a previous row of shift register; in the first gate driver on array sub-circuit 11, a reset signal terminal of the $N^{th}$ row of shift register RN is inputted with a reset signal, and each of the reset signal terminals of other rows of shift registers is connected to an output signal terminal of a next row of shift register. In the second gate driver on array sub-circuit 12, an input signal terminal of the first row of shift register R1 is inputted with the frame-start signal, and each of the input signal terminals of other rows of shift registers is connected to an output signal terminal of a previous row of shift register; in the second gate driver on array sub-circuit 12, a reset signal terminal of the $N^{th}$ row of shift register RN is inputted with a reset signal, and each of the reset signal terminals of other rows of shift registers is connected to an output signal terminal of a next row of shift register.

In the present embodiment, the output signal terminals of the shift registers in the first gate driver on array sub-circuit 11 are connected to those of respective shift registers in the second gate driver on array sub-circuit 12. For example, the output signal terminal of the first row of shift register R1 of the first gate driver on array sub-circuit 11 is connected to that of the first row of shift register R1 of the second gate driver on array sub-circuit 12, and so on, until the output signal terminal of the $N^{th}$ row of shift register RN of the first gate driver on array sub-circuit 11 is connected to that of the $N^{th}$ row of shift register RN of the second gate driver on array sub-circuit 12. The connections between the output signal terminals of the first gate driver on array sub-circuit 11 and the second gate driver on array sub-circuit 12 ensure that the gate driver on array circuit can normally output signals after switching to the second gate driver on array sub-circuit 12.

Figure 2:
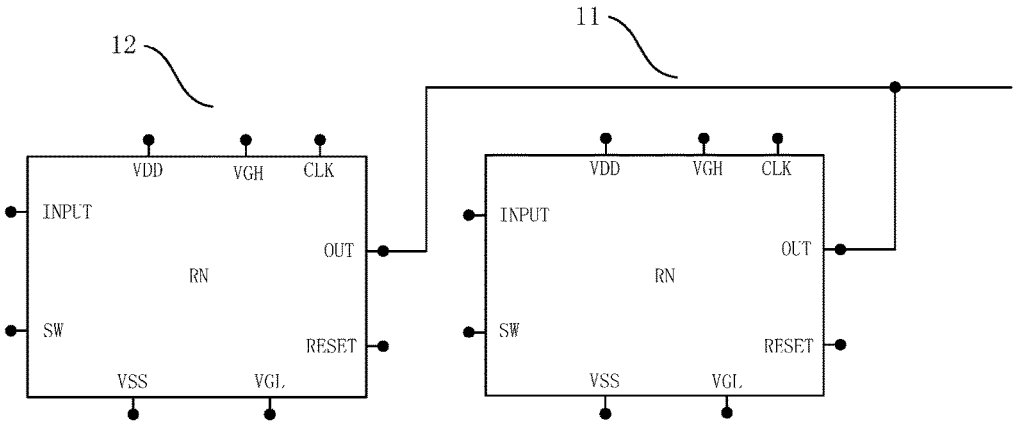
FIG. 2 is a schematic diagram of signal terminals of a shift register in FIG. 1.
Figure 3:
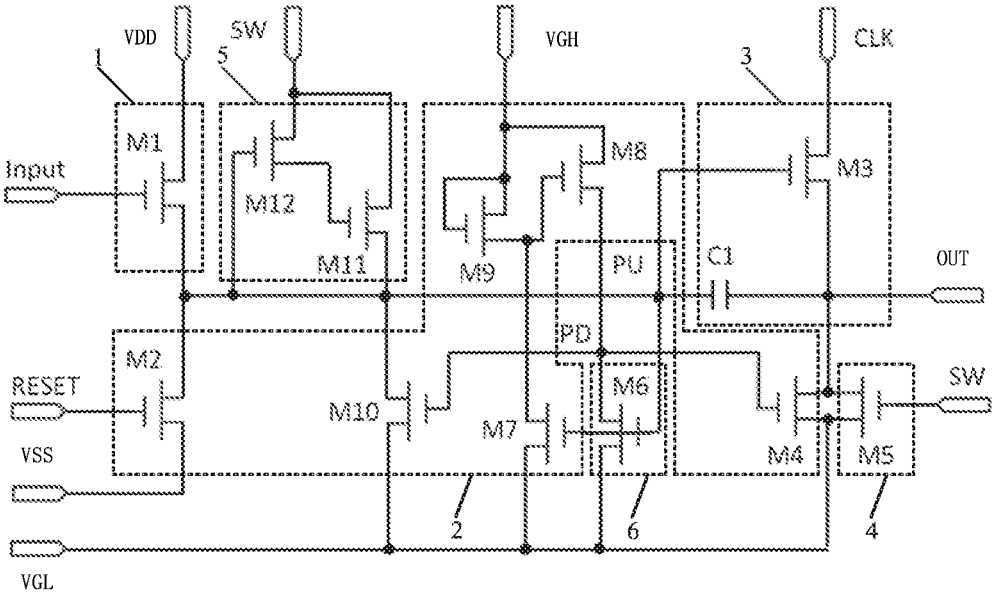
FIG. 3 is a schematic diagram of a structure of the shift register in FIG. 1.

FIG. 2 is a schematic diagram of signal terminals of a shift register in FIG. 1. As shown in FIG. 2, description will be made to FIG. 2 by taking the $N^{th}$ row of shift register RN of the first gate driver on array sub-circuit 11 and the respective $N^{th}$ row of shift register RN of the second gate driver on array sub-circuit 12 as an example. Each shift register RN comprises a plurality of signal terminals, as shown in FIG. 2, and for example, the shift register RN comprises an input signal terminal INPUT, an output signal terminal OUT, a clock signal terminal CLK, a reset signal terminal RESET and power signal terminals SW, VDD, VSS, VGL, and VGH, wherein, as shown in FIG. 3, SW is a switch power supply, VDD is a first power supply, VSS is a second power supply, VGL is a third power supply, and VGH is a fourth power supply. It should be noted that the signal terminals of the shift register include, but are not limited to, the signal terminals as shown in FIG. 2, the signal terminals in FIG. 2 are only shown by way of example, and in practical applications, the signal terminals of the shift register may be modified according to the actual circuit structure, for example, a frame-start signal terminal STV may be additionally provided in the shift register.

When no defect occurs in the first gate driver on array sub-circuit 11, the signal terminals of its shift registers are inputted with normal working signals, and normal output signals are output by the output signal terminals OUT; in this case, the clock signal terminals CLK of the shift registers of the second gate driver on array sub-circuit 12 are inputted with a high level signal, and the input signal terminals INPUT, the reset signal terminals RESET and the power signal terminals SW, VDD, VSS, VGL and VGH each are inputted with a low level signal, thereby ensuring that the second gate driver on array sub-circuit 12 does not work.

When a defect occurs in the first gate driver on array sub-circuit 11, the first gate driver on array sub-circuit 11 stops driving, wherein the clock signal terminals CLK of the shift registers in the first gate driver on array sub-circuit 11 which stops driving are applied with a high level signal, and other signal terminals of the shift registers in the first gate driver on array sub-circuit 11 which stops driving are applied with a low level signal, thereby ensuring that the first gate driver on array sub-circuit 11 which stops driving will not work. In this case, the signal terminals of the second gate driver on array sub-circuit 12 are inputted with normal working signals, and signals are normally output by the output signal terminals OUT.

Alternatively, when a defect occurs in the first gate driver on array sub-circuit 11, the first gate driver on array sub-circuit 11 stops driving, wherein the clock signal terminals CLK of the shift registers in the first gate driver on array sub-circuit 11 which stops driving are applied with the clock signal, and other signal terminals of the shift registers in the first gate driver on array sub-circuit 11 which stops driving are applied with a low level signal, thereby ensuring that the first gate driver on array sub-circuit 11 which stops driving will not work. In this case, the signal terminals of the second gate driver on array sub-circuit 12 are inputted with normal working signals, and signals are normally output by the output signal terminals OUT.

FIG. 3 is a schematic diagram of a structure of the shift register in FIG. 1. As shown in FIG. 3, the shift register comprises a precharge module 1, a reset module 2, a pull-up control module 3 and a noise discharge module 4, wherein the precharge module 1 is connected to the reset module 2 and a pull-up node PU, the reset module 2 is connected to the pull-up node PU, the noise discharge module 4 and the output signal terminal OUT, the pull-up control module 3 is connected to the pull-up node PU, the noise discharge module 4 and the output signal terminal OUT, and the noise discharge module 4 is connected to the output signal terminal OUT. The precharge module 1 is configured to charge the pull-up node PU in a precharge stage. The noise discharge module 4 is configured to discharge the noise from the output signal terminal in a touch control stage. The pull-up control module 3 is configured to pull up the electric potential of the pull-up node PU and output a driving signal via the output signal terminal OUT in an output stage. The reset module 2 is configured to reset the pull-up node PU and the output signal terminal OUT in a reset stage, and discharge the noise from the pull-up node PU and the output signal terminal OUT in a noise discharge stage. Further, the shift register further comprises a compensation module 5 connected to the pull-up node PU and configured to charge the pull-up node in the touch control stage. Further, the shift register further comprises a pull-down control module 6 connected to the pull-up node PU and a pull-down node PD, and the reset module 2 is also connected to the pull-down node PD. The pull-down control module 6 is configured to pull down the electric potential of the pull-down node PD.

In the present embodiment, the precharge module 1 comprises a first transistor M1. A control electrode of the first transistor M1 is connected to the input signal terminal Input, a first electrode of the first transistor M1 is connected to the first power supply VDD, and a second electrode of the first transistor M1 is connected to the pull-up node PU. The reset module 2 comprises a second transistor M2, a fourth transistor M4, a seventh transistor M7, an eighth transistor M8, a ninth transistor M9 and a tenth transistor M10. A control electrode of the second transistor M2 is connected to the reset signal terminal RESET, a first electrode of the second transistor M2 is connected to the pull-up node PU, and a second electrode of the second transistor M2 is connected to the second power supply VSS; a control electrode of the fourth transistor M4 is connected to the pull-down node PD, a first electrode of the fourth transistor M4 is connected to the pull-up control module 3, the output signal terminal OUT and the noise discharge module 4, and a second electrode of the fourth transistor M4 is connected to the third power supply VGL and the noise discharge module 4; a control electrode of the seventh transistor M7 is connected to the pull-up node PU, a first electrode of the seventh transistor M7 is connected to a control electrode of the eighth transistor M8 and a second electrode of the ninth transistor M9, and a second electrode of the seventh transistor M7 is connected to the third power supply VGL; the control electrode of the eighth transistor M8 is connected to the second electrode of the ninth transistor M9, a first electrode of the eighth transistor M8 is connected to the fourth power supply VGH and a control electrode of the ninth transistor M9, and the second electrode of the eighth transistor M8 is connected to the pull-down node PD; the control electrode of the ninth transistor M9 is connected to a first electrode of the ninth transistor M9 and the fourth power supply VGH; a control electrode of the tenth transistor M10 is connected to the pull-down node PD, a first electrode of the tenth transistor M10 is connected to the pull-up node PU, and a second electrode of the tenth transistor M10 is connected to the third power supply VGL.

In the present embodiment, the pull-up control module 3 comprises a third transistor M3 and a capacitor C1. A control electrode of the third transistor M3 is connected to the pull-up node PU, a first electrode of the third transistor M3 is connected to the clock signal terminal, and a second electrode of the third transistor M3 is connected to a second terminal of the capacitor C1, the output signal terminal OUT and the noise discharge module 4; a first terminal of the capacitor C1 is connected to the pull-up node PU, and the second terminal of the capacitor C1 is connected to the output signal terminal OUT, the reset module 2 and the noise discharge module 4.

In the present embodiment, the noise discharge module 4 comprises a fifth transistor M5. A control electrode of the fifth transistor M5 is connected to the switch power supply SW, a first electrode of the fifth transistor M5 is connected to the reset module 2, the output signal terminal OUT and the pull-up control module 3, and the second electrode of the fifth transistor M5 is connected to the reset module 2 and the third power supply VGL.

In the present embodiment, the compensation module 5 comprises an eleventh transistor M11 and a twelfth transistor M12. A control electrode of the eleventh transistor M11 is connected to a second electrode of the twelfth transistor M12, a first electrode of the eleventh transistor M11 is connected to the switch power supply SW and a first electrode of the twelfth transistor M12, and a second electrode of the eleventh transistor M11 is connected to the pull-up node PU; a control electrode of the twelfth transistor M12 is connected to the pull-up node PU; the first electrode of the twelfth transistor M12 is connected to the switch power supply SW.

In the present embodiment, the pull-down control module 6 comprises a sixth transistor M6. A control electrode of the sixth transistor M6 is connected to the pull-up node PU, a first electrode of the sixth transistor M6 is connected to the pull-down node PD, and a second electrode of the sixth transistor M6 is connected to the third power supply VGL.

Specifically, the first electrode of the fourth transistor M4 is connected to the first electrode of the fifth transistor M5 and the second electrode of the third transistor M3, the second terminal of the capacitor C1 and the output signal terminal OUT, and the second electrode of the fourth transistor M4 is connected to the second electrode of the fifth transistor M5 and the third power supply VGL. The control electrode of the tenth transistor M10 is connected to the pull-down node PD. The second electrode of the third transistor M3 is connected to the first electrode of the fourth transistor M4, the first electrode of the fifth transistor M5, the second terminal of the capacitor C1 and the output signal terminal OUT. The second terminal of the capacitor C1 is connected to the first electrode of the fourth transistor M4, the first electrode of the fifth transistor M5 and the output signal terminal OUT.

A working mode of the shift register in FIG. 3 includes a compatible mode including a precharge stage, an output stage, a reset stage and a noise discharge stage.

In the precharge stage, the first transistor M1 is turned on under the control of an input signal output by the input signal terminal input, wherein the input signal output by the input signal terminal Input is an output signal output by the output signal terminal OUT of a previous row of shift register, which is a high level signal. The clock signal output by the clock signal terminal CLK is a low level signal, and since the first transistor M1 is turned on, the first power supply VDD charges the capacitor C1 via the first transistor M1 such that the voltage at the pull-up node PU is pulled up, and the voltage output by the first power supply VDD is at a high level at this moment. The third transistor M3, the sixth transistor M6 and the seventh transistor M7 are turned on under the control of the voltage at PU, and the voltage at the node PU is at a high level at this moment. The seventh transistor M7 is turned on such that the voltage of the control electrode of the eighth transistor M8 becomes the voltage output by the third power supply VGL, and the eighth transistor M8 is turned off under the control of the voltage output by the third power supply VGL, and the voltage output by the third power supply VGL is at a low level at this moment. The sixth transistor M6 is turned on such that the voltage at the pull-down node becomes the voltage output by the third power supply VGL, and since the voltage output by the third power supply VGL is at a low level, the voltage at the pull-down node PD is at a low level, and the fourth transistor M4 and the tenth transistor M10 are turned off under the control of the voltage at the pull-down node PD. The fifth transistor M5 is turned off under the control of the voltage output by the switch power supply SW, and the voltage output by the switch power supply SW is at a low level at this moment. The fourth transistor M4, the fifth transistor M5 and the tenth transistor M10 are turned off, thereby ensuring that the signal from the output signal terminal OUT is output stably.

In the output stage, the fifth transistor M5 is turned off under the control of the voltage output by the switch power supply SW, and the voltage output by the switch power supply SW is at a low level at this moment. The twelfth transistor M12 is turned on under the control of the voltage at the pull-up node PU, and thus the eleventh transistor M11 is turned off under the control of the voltage output by the switch power supply SW. In this case, the first transistor M1 is turned off under the control of the input signal output by the input signal terminal Input, wherein the input signal output by the input signal terminal Input is the output signal output by the output signal terminal OUT of the previous row of shift register, which is a low level signal. The voltage of the pull-up node PU remains at a high level, and thus the third transistor M3 remains on under the control of the voltage of the pull-up node PU. In this case, since the clock signal output by the clock output signal terminal CLK is at a high level, the voltage at the pull-up node PU is amplified due to the bootstrapping effect, thereby finally achieving transmission of a driving signal to the output signal terminal OUT such that the driving signal is output via the output signal terminal OUT. At this moment, the sixth transistor M6 and the seventh transistor M7 are still on under the control of the voltage at the node PU such that the fourth transistor M4 and the tenth transistor M10 are still off, and the fifth transistor M5 is still off under the control of the voltage output by the switch power supply SW, thereby ensuring that the signal from the output signal terminal OUT is output stably.

In the reset stage, the second transistor M2 is turned on under the control of the reset signal output by the reset signal terminal RESET, wherein the reset signal output by the reset signal terminal RESET is the output signal output by the output signal terminal OUT of the next row of shift register, which is a high level signal. After the second transistor M2 is turned on, the voltage at the pull-up node PU is pulled down to the voltage output by the second power supply VSS by the influence of the latter. At this moment, since the voltage output by the second power supply VSS is at a low level, the voltage at the pull-up node PU is at a low level, causing the third transistor M3, the sixth transistor M6 and the seventh transistor M7 are turned off. The ninth transistor M9 and the eighth transistor M8 are turned on under the control of the voltage output by the fourth power supply VGH which is at a high level, and thereby the voltage at the pull-down PD is pulled up and at a high level. The fourth transistor M4 and the tenth transistor M10 are turned on under the control of the pull-down node PD, so that the voltage at the pull-up node PU is pulled down, via the tenth transistor M10, to the voltage output by the third power supply VGL, and the voltage at the output signal terminal OUT is pulled down, via the fourth transistor M4, to the voltage output by the third power supply VGL, wherein the voltage output by the third power supply VGL is at a low level.

In the noise discharge stage, no signal is output from the output signal terminal OUT, and the first transistor M1 remains off. The eighth transistor M8 and the ninth transistor M9 remain on, so that the voltage at the pull-down node PD remains at a high level while no signal is output from the output signal terminal OUT and the fourth transistor M4 and the tenth transistor M10 are turned on. The tenth transistor M10 discharges the noise from the pull-up node PU continuously, and the fourth transistor M4 discharges the noise from the output signal terminal OUT continuously. Such a noise discharge process can eliminate the coupling noise generated by the clock signal terminal, ensuring stability of the output signal.

The gate shift register repeats the noise discharge stage so as to discharge the noise continuously, until the next frame of display image is coming. In a stage before the next frame of image comes and after the displaying the current frame of image ends (i.e., in the V-Blank (vertical blanking) stage), the fifth transistor M5 is turned on under the control of the voltage output by the switch power supply SW so as to discharge the noise from the output signal terminal OUT, wherein the voltage output by the switch power supply SW is at a high level at this moment. However, since the voltage of the pull-up node PU is at a low level, the twelfth transistor M12 is turned off under the control of the voltage of the pull-up node PU, and thereby the eleventh transistor M11 is also turned off. In this case, if it is required to perform a touch control function, the touch control process may be implemented in the V-Blank stage. Since the noise from the output signal terminal OUT is discharged continuously in the V-Blank stage, the interference on the touch control signal by the driving signal output from the output signal terminal can be avoided. From the foregoing, the compatible mode may serve as the V-Blank mode in which the touch control is performed in the V-Blank stage. Furthermore, if the display device does not perform the above-mentioned touch control process, the compatible mode may also serve as a display mode in which no touch control is performed.

In sum, the compatible mode is compatible with both the display mode and the V-Blank mode, and thus such the compatible mode is compatible with a traditional gate driving mode and a V-Blank gate driving mode with a touch control function being built therein.

The working mode of the shift register shown in FIG. 3 further includes a horizontal blanking (H-Blank) mode including a precharge stage, a touch control stage, an output stage, a reset stage and a noise discharge stage.

In the precharge stage, the first transistor M1 is turned on under the control of the input signal output by the input signal terminal Input, wherein the input signal output by the input signal terminal Input is an output signal output by the output signal terminal OUT of a previous row of shift register, which is a high level signal. The clock signal output by the dock signal terminal CLK is a low level signal, and since the first transistor M1 is turned on, the first power supply VDD charges the capacitor C1 via the first transistor M1 such that the voltage at the pull-up node PU is pulled up, and the voltage output by the first power supply VDD is at a high level at this moment. The third transistor M3, the sixth transistor M6 and the seventh transistor M7 are turned on under the control of the voltage at PU, and the voltage at the node PU is at a high level at this moment. The seventh transistor M7 is turned on such that the voltage of the control electrode of the eighth transistor M8 becomes the voltage output by the third power supply VGL, and the eighth transistor M8 is turned off under the control of the voltage output by the third power supply VGL, and the voltage output by the third power supply VGL, is at a low level at this moment. The sixth transistor M6 is turned on such that the voltage at the pull-down node PD becomes the voltage output by the third power supply VGL, and since the voltage output by the third power supply VGL is at a low level, the voltage at the pull-down node PD is at a low level, and the fourth transistor M4 and the tenth transistor M10 are turned off under the control of the voltage at the pull-down node PD. The fifth transistor M5 is turned off under the control of the voltage output by the switch power supply SW, and the voltage output by the switch power supply SW is at a low level at this moment. The fourth transistor M4, the fifth transistor M5 and the tenth transistor M10 are turned off, thereby ensuring that the signal from the output signal terminal OUT is output stably.

In the touch control stage, i.e., the H-Blank stage, the voltage at the pull-up node PU remains at a high level continuously, the twelfth transistor M12 is turned on under the control of the voltage at the pull-up node PU, the voltage output by the switch power supply SW is at a high level, and the eleventh transistor M11 is turned on under the control of the voltage output by the switch power supply SW. Since the voltage output by the switch power supply SW, the fifth transistor M5 is turned on under the control of the voltage output by the switch power supply SW and discharges the noise from the output signal terminal OUT such that no driving signal is output from the output signal terminal OUT, thereby avoiding the interference to the touch control signal by the driving signal, and thus ensuring the touch control function. Since the eleventh transistor M11 is turned on, the switch power supply SW may supplementally charge the pull-up node PU such that the voltage at the pull-up node PU may remain at a high level and not drop down. Since the switch power supply SW supplementally charges the pull-up node PU only via one transistor (the eleventh transistor M11), the compensation module achieves excellent charging effect. When the pull-up node PU is supplementally charged, the voltage at the pull-up node PU remains at a high level and does not drop down. Meanwhile, since the voltages at respective pull-up nodes PU of other rows of shift registers are all at a low level, subsequent operations of other rows of shift registers will not be influenced.

In the output stage, the fifth transistor M5 is turned off under the control of the voltage output by the switch power supply SW, and the voltage output by the switch power supply SW is at a low level at this moment. The twelfth transistor M12 is turned on under the control of the voltage at the pull-up node PU, and thus the eleventh transistor M11 is turned off under the control of the voltage output by the switch power supply SW. In this case, the first transistor M1 is turned off under the control of the input signal output by the input signal terminal Input, wherein the input signal output by the input signal terminal Input is the output signal output by the output signal terminal OUT of the previous row of shift register, which is a low level signal. The voltage at the pull-up node PU remains at a high level, and thus the third transistor M3 remains on under the control of the voltage at the pull-up node PU. In this case, since the clock signal output by the clock output signal terminal CLK is at a high level, the voltage at the pull-up node PU is amplified due to the bootstrapping effect, thereby eventually achieving transmission of a driving signal to the output signal terminal OUT so as to output the driving signal via the output signal terminal OUT. At this moment, the sixth transistor M6 and the seventh transistor M7 are still on under the control of the voltage at the node PU such that the fourth transistor M4 and the tenth transistor M10 are still off, and the fifth transistor M5 is still off under the control of the voltage output by the switch power supply SW, thereby ensuring that the signal from the output signal terminal OUT is output stably.

In the reset stage, the second transistor M2 is turned on under the control of the reset signal output by the reset signal terminal RESET, wherein the reset signal output by the reset signal terminal RESET is the output signal output by the output signal terminal OUT of the next row of shift register, which is a high level signal. After the second transistor M2 is turned on, the voltage at the pull-up node PU is pulled down to the voltage output by the second power supply VSS by the influence of the latter. At this moment, since the voltage output by the second power supply VSS is at a low level, the voltage at the pull-up node PU is at a low level, causing the third transistor M3, the sixth transistor M6 and the seventh transistor M7 are turned off. The ninth transistor M9 and the eighth transistor M8 are turned on under the control of the voltage output by the fourth power supply VGH which is at a high level, and thereby the voltage at the pull-down PD is pulled up and at a high level. The fourth transistor M4 and the tenth transistor M10 are turned on under the control of the pull-down node PD, so that the voltage at the pull-up node PU is pulled down, via the tenth transistor M10, to the voltage output by the third power supply VGL, and the voltage of the output signal terminal OUT is pulled down, via the fourth transistor M4, to the voltage output by the third power supply VGL, wherein the voltage output by the third power supply VGL is at a low level.

In the noise discharge stage, no signal is output from the output signal terminal OUT, and the first transistor M1 remains off. The eighth transistor M8 and the ninth transistor M9 remains on, so that the voltage of the pull-down node PD remains at a high level while no signal is output from the output signal terminal OUT and the fourth transistor M4 and the tenth transistor M10 are turned on. The tenth transistor M10 discharges the noise from the pull-up node PU continuously, and the fourth transistor M4 discharges the noise from the output signal terminal OUT continuously. Such a noise discharge process can eliminate the coupling noise generated by the clock signal terminal, ensuring stability of the output signal.

The gate shift register repeats the noise discharge stage so as to discharge the noise continuously, until the next frame of display image is coming. In a stage before the next frame of image comes and after the displaying of the current frame of image ends(i.e., in the V-Blank (vertical blanking) stage), the fifth transistor M5 is turned on under the control of the voltage output by the switch power supply SW so as to discharge the noise from the output signal terminal OUT, wherein the voltage output by the switch power supply SW is at a high level at this moment. However, since the voltage at the pull-up node PU is at a low level, the twelfth transistor M12 is turned off under the control of the voltage at the pull-up node PU, and thereby the eleventh transistor M12 is also turned off. Thus, this H-Blank mode is applicable to a H-Blank gate driving mode with a touch control function being built therein.

In the present embodiment, the shift register shown in FIG. 3 is only an example. In practical applications, this shift register may be implemented in other structures, the examples of which will not be exhaustively listed here.

In the present embodiment, the input signal terminal of the first gate driver on array sub-circuit 11 is connected only to the control electrode of the first transistor M1, and not concurrently connected to the first electrode of the first transistor M1, and thereby preventing the input signal terminal and the output signal terminal from being connected with each other when the first transistor M1 is turned on, which in turn preventing the output signal terminal of the second gate driver on array sub-circuit 12 from being influenced by the input signal terminal of the first gate driver on array sub-circuit 11 that would be caused by connecting the output signal terminal of the first gate driver on array sub-circuit 11 with the output signal terminal of the second gate driver on array sub-circuit 12.

In the present embodiment, after the first gate driver on array sub-circuit 11 stops driving and the second gate driver on array sub-circuit 12 takes over to start driving, the power consumption of the second gate driver on array sub-circuit 12 is constant. As shown in FIGS. 1 and 2, since the output signal terminal of the second gate driver on array sub-circuit 12 is connected with the output signal terminal of the first gate driver on array sub-circuit 11, the driving signal output by the output signal terminal OUT of the second gate driver on array sub-circuit 12 may also be transferred to the output signal terminal OUT of the first gate driver on array sub-circuit 11. Referring further to FIG. 3, with the coupling effect of the capacitor C1 in the shift registers of the first gate driver on array sub-circuit 11, the voltage of the output signal terminal OUT of the first gate driver on array sub-circuit 11 becomes high from low, thereby the voltage at the pull-up node PU may also rise to some extent, and the third transistor M3 may be somewhat turned on under the action of the pull-up node PU. In this case, if a low level signal is applied to the first electrode of the third transistor M3 from the clock signal terminal CLK of the shift register of the first gate driver on array sub-circuit 11, part of the driving signal output by the output signal terminal OUT of the second gate driver on array sub-circuit 12 may be output via the third transistor M3 of the shift register of the first gate driver on array sub-circuit 11, resulting in dropping of the voltage of the output signal terminal OUT of the second gate driver on array sub-circuit 12. In order to solve the above problem, the dock signal terminals CLK of the shift registers in the first gate driver on array sub-circuit 11 may be applied with a high level signal or a clock signal so as to avoid the problem that the voltage of the output signal terminal OUT of the second gate driver on array sub-circuit 12 drops. When the clock signal terminals CLK of the shift registers in the first gate driver on array sub-circuit 11 are applied with a high level signal, since the high level signal is a direct current signal, it will not charge or discharge the third transistors M3 of the shift registers in the first gate driver on array sub-circuit 11, thus not increasing the power consumption of the first gate driver on array sub-circuit 11; when the dock signal terminals CLK of the shift registers in the first gate driver on array sub-circuit 11 are applied with a clock signal, since the dock signal is not a direct current signal, it will charge or discharge the third transistors M3 of the shift registers in the first gate driver on array sub-circuit 11, thus increasing the power consumption of the first gate driver on array sub-circuit 11. To sum up, it is preferred to load a high level signal to the clock signal terminals CLK of the shift registers in the first gate driver on array sub-circuit 11.

In the gate driver on array circuit provided by the present embodiment, the first gate driver on array sub-circuit stops driving when a defect occurs therein, and the second gate driver on array sub-circuit performs driving when the defect occurs in the first gate driver on array sub-circuit, thereby improving the yield rate of the gate driver on array circuit.

Figure 4:
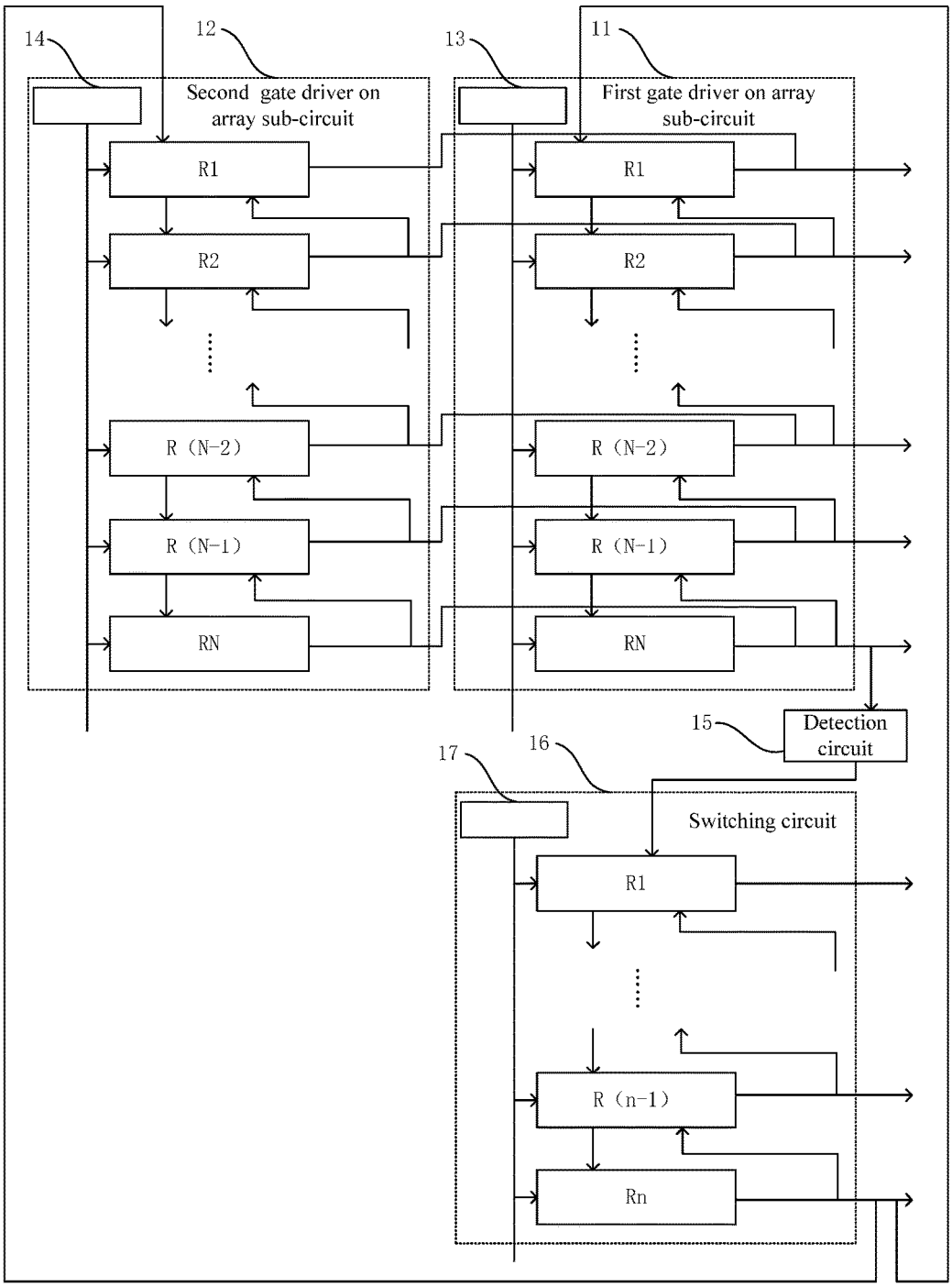
FIG. 4 is a schematic diagram of a structure of a gate driver on array circuit provided by Embodiment 2 of the present invention.

FIG. 4 is a schematic diagram of a structure of a gate driver on array circuit provided by Embodiment 2 of the present invention. As shown in FIG. 4, the gate driver on array circuit comprises a first gate driver on array sub-circuit 11 and a second gate driver on array sub-circuit 12. The first gate driver on array sub-circuit 11 is configured to drive in a first working state; the second gate driver on array sub-circuit 12 is configured to drive in a second working state.

In the present embodiment, the gate driver on array circuit may work in the first working state or the second working state such that the first gate driver on array sub-circuit 11 performs driving when the gate driver on array circuit is in the first working state and the second gate driver on array sub-circuit 12 performs driving when the gate driver on array circuit is in the second working state, and thus the first gate driver on array sub-circuit 11 and the second gate driver on array sub-circuit 12 perform driving in different working states.

In the gate driver on array circuit provided by the present embodiment, the first gate driver on array sub-circuit performs driving in the first working state, and the second gate driver on array sub-circuit performs driving in the second working state, thereby improving the yield rate of the gate driver on array circuit.

Preferably, the first working state is a state in which no defect occurs in the first gate driver on array sub-circuit 11, and the second working state is a state in which a defect occurs in the first gate driver on array sub-circuit 11. When the gate driver on array circuit is in the first working state, specifically, the first gate driver on array sub-circuit 11 is configured to perform driving in the case where no defect occurs in the first gate driver on array sub-circuit 11; when the gate driver on array circuit is in the second working state, specifically, the second gate driver on array sub-circuit 12 is configured to performing driving in the case where the first gate driver on array sub-circuit 11 stops driving due to occurrence of a defect.

In the present embodiment, in the first working state, the first gate driver on array sub-circuit 11 is a working gate driver on array sub-circuit while the second gate driver on array sub-circuit 12 is a standby gate driver on array sub-circuit, and the first gate driver on array sub-circuit 11 performs driving while the second gate driver on array sub-circuit 12 does not perform driving; in the second working state, the first gate driver on array sub-circuit 11 stops driving and the standby second gate driver on array sub-circuit 12 begins to drive.

In the present embodiment, the gate driver on array circuit further comprises a detection circuit 15 and a switching circuit 16. The detection circuit 15 is configured to receive an abnormal signal output by the first gate driver on array sub-circuit 11 when a defect occurs therein, generate a starting signal according to the abnormal signal, and output the starting signal to the switching circuit 16. The switching circuit 16 is configured to be started according to the starting signal, and output a switching signal to the first gate driver on array sub-circuit 11 and the switching signal to the second gate driver on array sub-circuit 12. The first gate driver on array sub-circuit 11 is specifically configured to stop driving according to the switching signal. The second gate driver on array sub-circuit 12 is specifically configured to drive according to the switching signal.

After the manufacture of a display device provided with the gate driver on array circuit of the present embodiment is finished, it is required for the display device to be tested. During the testing, the gate driver on array circuit first performs driving by using the first gate driver on array sub-circuit 11. If the display device displays normally, it means that there is no defect occurring in the first gate driver on array sub-circuit 11, and the driving is continued by the first gate driver on array sub-circuit 11. If a defect of no output occurs in the display device, the first gate driver on array sub-circuit 11 stops driving, and the gate driver on array circuit switches automatically to the second gate driver on array sub-circuit 12 to perform driving.

In the present embodiment, the first gate driver on array sub-circuit 11 and the second gate driver on array sub-circuit 12 each include a plurality of cascaded shift registers. As shown in FIG. 4, the first gate driver on array sub-circuit 11 comprises a first row of shift register R1, a second row of shift register R2, . . . , an $N^{th}$ row of shift register RN, and the second gate driver on array sub-circuit 12 comprises a first row of shift register R1, a second row of shift register R2, . . . , an $N^{th}$ row of shift register RN. The first gate driver on array sub-circuit 11 further comprises a signal controller 13 configured to output control signals to each shift register. For example, the control signals may comprise a frame-start signal, a clock signal, etc., which will not be exhaustively listed here. The second gate driver on array sub-circuit 12 further comprises a signal controller 14 configured to output control signals to each shift register. For example, the control signals may comprise a frame-start signal, a clock signal, etc., which will not be exhaustively listed here. In the first gate driver on array sub-circuit 11, an input signal terminal of the first row of shift register R1 is inputted with the frame-start signal, and each of the input signal terminals of other rows of shift registers is connected to an output signal terminal of a previous row of shift register; in the first gate driver on array sub-circuit 11, a reset signal terminal of the $N^{th}$ row of shift register RN is inputted with a reset signal, and each of the reset signal terminals of other rows of shift registers is connected to an output signal terminal of a next row of shift register. In the second gate driver on array sub-circuit 12, an input signal terminal of the first row of shift register R1 is inputted with the frame-start signal, and each of the input signal terminals of other rows of shift registers is connected to an output signal terminal of a previous row of shift register; in the second gate driver on array sub-circuit 12, a reset signal terminal of the $N^{th}$ row of shift register RN is inputted with a reset signal, and each of the reset signal terminals of other rows of shift registers is connected to an output signal terminal of a next row of shift register. In the present embodiment, the output signal terminals of the shift registers in the first gate driver on array sub-circuit 11 are connected to those of respective shift registers in the second gate driver on array sub-circuit 12. For example, the output signal terminal of the first row of shift register R1 of the first gate driver on array sub-circuit 11 is connected to that of the first row of shift register R1 of the second gate driver on array sub-circuit 12, and so on, until the output signal terminal of the $N^{th}$ row of shift register RN of the first gate driver on array sub-circuit 11 is connected to that of the $N^{th}$ row of shift register RN of the second gate driver on array sub-circuit 12. The connections between the output signal terminals of the first gate driver on array sub-circuit 11 and the second gate driver on array sub-circuit 12 ensure that the gate driver on array circuit can normally output signals after switching to the second gate driver on array sub-circuit 12. In the present embodiment, the output signal terminal of the last row of shift register in the first gate driver on array sub-circuit 11 is connected with the input signal terminal of the detection circuit 15, and as shown in FIG. 4, the output signal terminal of the $N^{th}$ row of shift register in the first gate driver on array sub-circuit 11 is connected with the input signal terminal of the detection circuit 15. In the present embodiment, the switching circuit 16 comprises a plurality of cascaded shift registers. As shown in FIG. 4, the switching circuit 16 comprises a first row of shift register R1, a second row of shift register R2, . . . , an $n^{th}$ row of shift register Rn. The switching circuit 16 further comprises a signal controller 17 configured to output control signals to each shift register. For example, the control signals may comprise a frame-start signal, a clock signal, etc., which will not be exhaustively listed here. In the switching circuit 16, an input signal terminal of the first row of shift register R1 is inputted with the starting signal output by the detection circuit 15, and each of the input signal terminals of other rows of shift registers is connected to an output signal terminal of a previous row of shift register; in the switching circuit 16, a reset signal terminal of the $n^{th}$ row of shift register Rn is inputted with a reset signal, and each of the reset signal terminals of other rows of shift registers is connected to an output signal terminal of a next row of shift register. The input signal terminal of the first row of shift register of the switching circuit 16 is connected to the output signal terminal of the detection circuit 15, the output signal terminal of the last row of shift register of the switching circuit 16 is connected to the input signal terminal of the first row of shift register in the second gate driver on array sub-circuit 12, and the output signal terminal of the last row of shift register of the switching circuit 16 is connected to a switching signal terminal of the first row of shift register in the first gate driver on array sub-circuit 11, wherein the last row of shift register of the switching circuit 16 is the $n^{th}$ row of shift register.

Figure 5:
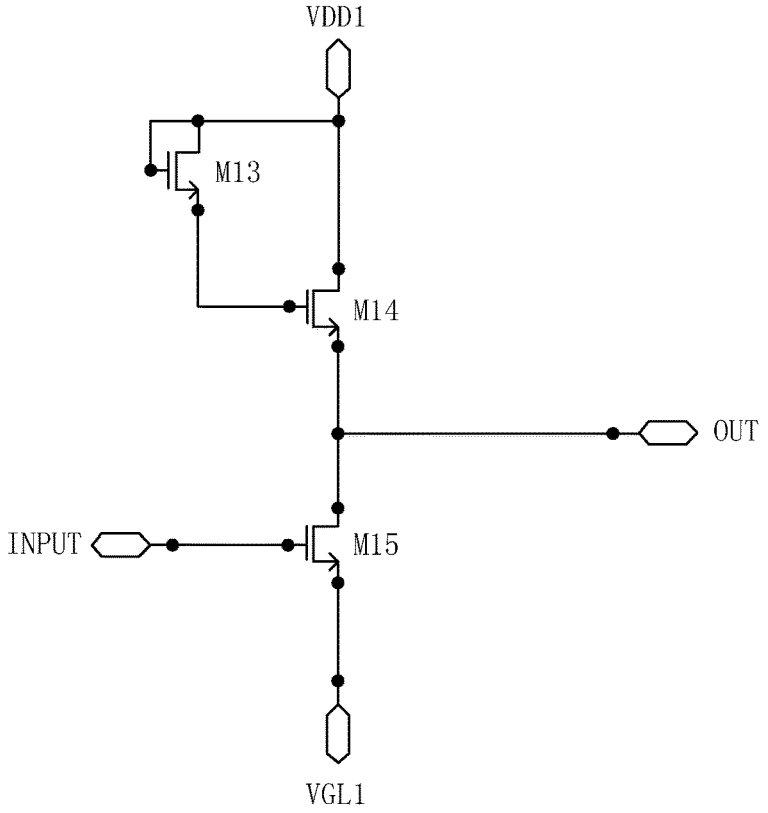
FIG. 5 is a schematic diagram of a structure of an inverter in Embodiment 2.

In the present embodiment, the detection circuit 15 is an inverter. FIG. 5 is a schematic diagram of a structure of the inverter in Embodiment 2. As shown in FIG. 5, the inverter may comprise a thirteenth transistor M13, the fourteenth transistor M14 and a fifteenth transistor M15, wherein both a control electrode and a first electrode of the thirteenth transistor M13 are connected to a fifth power supply VDD1, a second electrode of the thirteenth transistor M13 is connected to a control electrode of the fourteenth transistor M14, a first electrode of the fourteenth transistor M14 is connected to the fifth power supply VDD1, a second electrode of the fourteenth transistor M14 is connected to an output signal terminal OUT, a control electrode of the fifteenth transistor M15 is connected to an input signal terminal INPUT, a first electrode of the fifteenth transistor M15 is connected to the output signal terminal OUT, and a second electrode of the fifteenth transistor M15 is connected to a sixth power supply VGL1. When a defect occurs in the first gate driver on array sub-circuit 11, an output signal terminal of the $n^{th}$ row of shift register of the first gate driver on array sub-circuit 11 outputs an abnormal signal, which is a low level signal, to the control electrode of the fifteenth transistor M15, and the fifteenth transistor M15 is turned off under the control of the low level signal at this moment; the fifth power supply VDD1 outputs a high level signal, and thus both the thirteenth transistor M13 and the fourteenth transistor M14 are turned on under the control of the high level signal output by the fifth power supply VDD1; since the fifteenth transistor M15 is turned off, the output signal terminal outputs a high level signal, that is, the starting signal output by the output signal terminal to the input signal terminal of the first row of shift register of the switching circuit 16 is a high level signal. In the case where no defect occurs in the first gate driver on array sub-circuit 11, the output signal terminal of the $n^{th}$ row of shift register of the first gate driver on array sub-circuit 11 outputs a high level signal to the control electrode of the fifteenth transistor M15, and thereby the fifteenth transistor M15 is turned on under the control of the high level signal; the fifth power supply VDD1 outputs a high level signal, and both the thirteenth transistor M13 and the fourteenth transistor M14 are turned on under the control of the high level signal output by the fifth power supply VDD1; since the sixth power supply VGL1 outputs a low level signal, the output signal terminal outputs a low level signal when the fifteenth transistor M15 is turned on, that is, the output signal terminal outputs a low level signal to the input signal terminal of the first row of shift register of the switching circuit 16.

When the input signal terminal of the first row of shift register of the switching circuit 16 receives a low level signal, the switching circuit 16 will not work.

When the input signal terminal of the first row of shift register of the switching circuit 16 receives the starting signal which is a high level signal, the switching circuit 16 begins to work. In this case, the input signal terminal of each row of shift register of the switching circuit 16 outputs a driving signal, wherein the driving signal output by the output signal terminal of the $n^{th}$ row of shift register is a switching signal which is a high level signal. When the input signal terminal of the first row of shift register of the second gate driver on array sub-circuit 12 receives the switching signal, the second gate driver on array sub-circuit 12 begins to drive; on the contrary, when the input signal terminal of the first row of shift register of the first gate driver on array sub-circuit 11 receives the switching signal, the first gate driver on array sub-circuit 11 stops driving.

Figure 6:
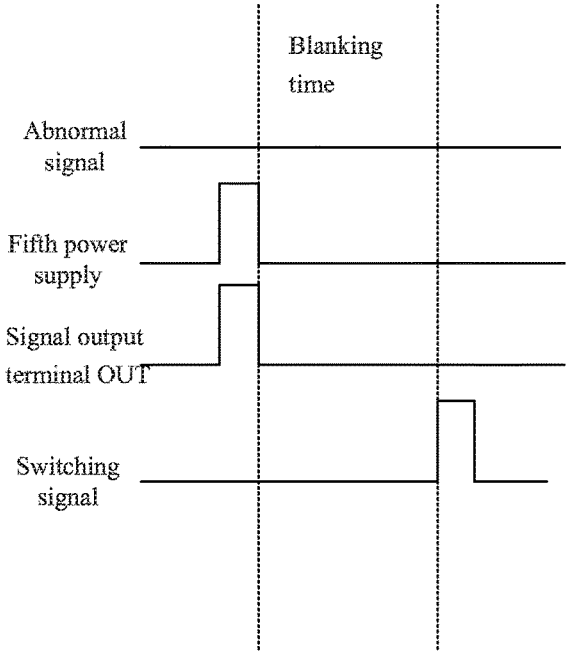
FIG. 6 is a schematic diagram of timing sequence of a switching circuit in FIG. 4.

FIG. 6 is a schematic diagram of timing sequence of a switching circuit in FIG. 4. As shown in FIGS. 4, 5 and 6, during the displaying of the display device, there is blanking time between two successive frames of display images. The blanking time is a V-Blank stage. The abnormal signal output by the $n^{th}$ row of shift register in the first gate driver on array sub-circuit 11 is a low level signal, the fifth power supply VDD1 of the inverter outputs a high level signal, the output signal terminal OUT of the inverter outputs a high level signal, and at this moment, the switching circuit 16 is turned on. The rows of shift register in the switching circuit 16 outputs a high level signal successively according to a timing sequence, until the $n^{th}$ row of shift register outputs a switching signal. In other words, the first row to the $n\text{-}1^{th}$ row of shift registers in the switching circuit 16 outputs a high level signal successively in the blanking time, while the $n^{th}$ row of shift register in the switching circuit 16 outputs a switching signal, which is a high level signal, upon the blanking time is end (i.e., at the beginning of the next frame of display image). Since the next frame of display image is driven by the second gate driver on array sub-circuit 12 after switching, the timing of the switching signal is the same as that of the frame-start signal of the input signal terminal of the first row of shift register of the second gate driver on array sub-circuit 12. In sum, the number of rows of the shift registers in the switching circuit 16 is determined according to the blanking time between two frames of display images such that the switching signal output by the last row of shift register of the switching circuit 16 has the same timing sequence as that of the frame-start signal of the first row of shift register of the second gate driver on array sub-circuit 12.

Figure 7:
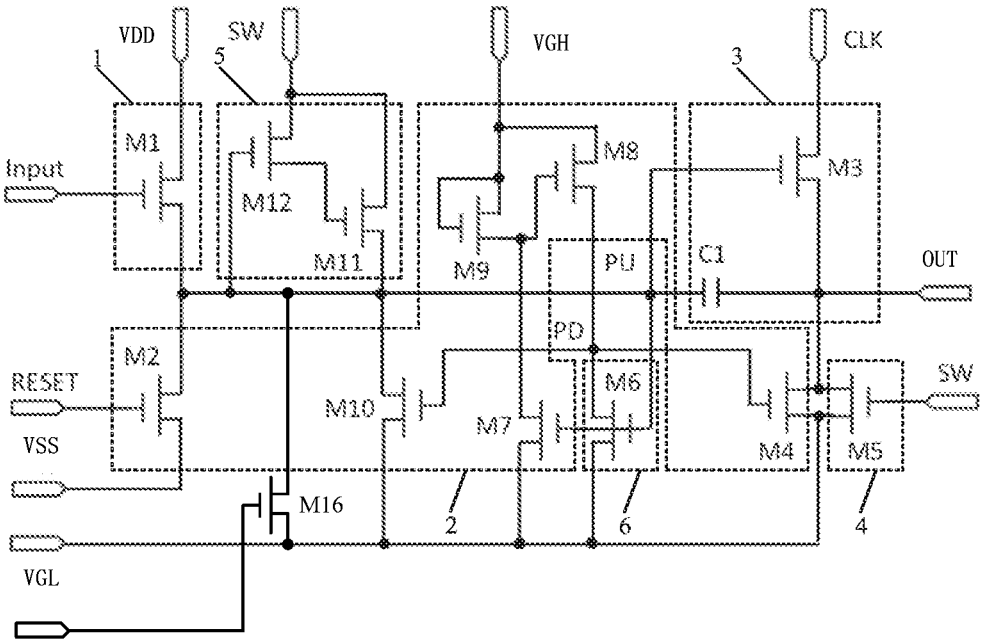
FIG. 7 is a schematic diagram of a structure of a first row of shift register of a first gate driver on array sub-circuit in FIG. 4.

FIG. 7 is a schematic diagram of a structure of the first row of shift register of the first gate driver on array sub-circuit in FIG. 4. As shown in FIG. 7, on the basis of the shift register in FIG. 3, the first row of shift register of the first gate driver on array sub-circuit 11 comprises a switching transistor M16. A control electrode of the switching transistor M16 is connected to the output signal terminal of the last row of shift register in the switching circuit 16, a first electrode of the switching transistor M16 is connected to the pull-up node PU, and a second electrode of the switching transistor M16 is connected to a low level signal terminal. As shown in FIGS. 6 and 7, in the case where the output signal terminal of the $n^{th}$ row of shift register in the switching circuit 16 outputs the switching signal and the switching signal is a high level signal, the switching transistor M16 is turned on under the control of the high level signal; the low level signal terminal to which the second electrode of the switching transistor M16 is connected is the third power supply VGL in FIG. 7, which outputs a low level signal such that the voltage of the second electrode of the switching transistor M16 is a low level signal, thereby causing the voltage at the pull-up node PU to be a low level signal, preventing effectively the pull-up node PU of the first row of shift register in the first gate driver on array sub-circuit 11 with a defect from being charged, and then ensuring that the first gate driver on array sub-circuit 11 stops driving. Descriptions on other components of the shift register in FIG. 7 may be referred to descriptions on FIG. 3, and will not be repeated here. In addition, in the present embodiment, the shift register in FIG. 3 may be used as each of other rows of shift registers in the first gate driver on array sub-circuit 11 and the shift registers in the second gate driver on array sub-circuit 12.

Figure 8:
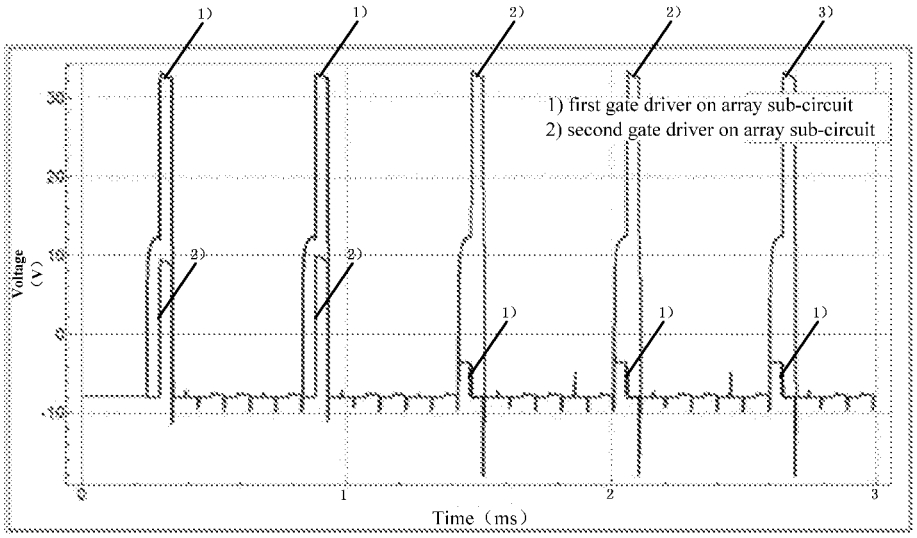
FIG. 8 is a timing diagram of a pull-up node in FIG. 3.

FIG. 8 is a timing diagram of the pull-up node in FIG. 3. As shown in FIG. 8, a voltage at the pull-up node of the first row of shift register of the first gate driver on array sub-circuit 11 and a voltage at the pull-up node of the first row of shift register of the second gate driver on array sub-circuit 12 are detected, respectively. In FIG. 8, the voltage at the pull-up node during 5 successive frames of display images are shown. From FIG. 8 it can be seen that, initially, the voltage at the pull-up node of the first row of shift register of the first gate driver on array sub-circuit 11 is higher than the voltage at the pull-up node of the first row of shift register of the second gate driver on array sub-circuit 12, and thus the first two frames of display images both are driven by the first gate driver on array sub-circuit 11; hereafter, the voltage at the pull-up node of the first row of shift register of the second gate driver on array sub-circuit 12 is higher than the voltage at the pull-up node of the first row of shift register of the first gate driver on array sub-circuit 11, and thus the sub-circuit being working is switched from the first gate driver on array sub-circuit 11 to the second gate driver on array sub-circuit 12, thereby the last three frames of display images all are driven by the second gate driver on array sub-circuit 12.

Figure 9:
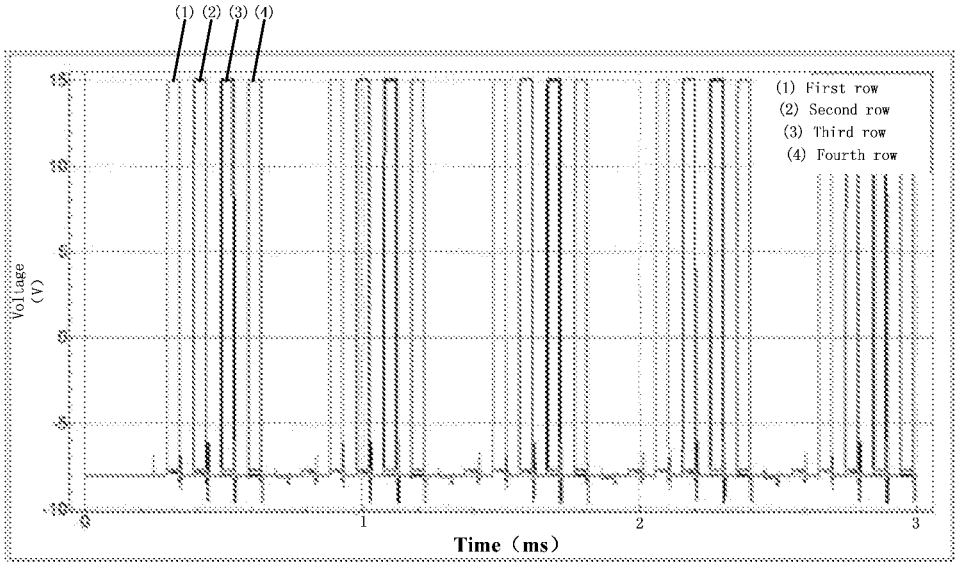
FIG. 9 is a timing diagram of a driving signal output by the gate driver on array circuit in FIG. 1.

FIG. 9 is a timing diagram of driving signals output by the gate driver on array circuit in FIG. 1. As shown in FIG. 9, the voltages of the driving signals output by the gate driver on array circuit during 5 successive frames of display images are shown; during each frame of display image, 4 rows of driving signals, which are the driving signals output by the first, the third, the fifth, and the seventh rows of shift registers, respectively, are detected. The first and the second frames of display image are driven by the first gate driver on array sub-circuit 11, and the third, the fourth and the fifth frames of display images are driven by the second gate driver on array sub-circuit 12.

As can be seen from the simulation diagrams shown in FIGS. 8 and 9, although switching between the gate driver on array sub-circuits occurs during displaying, there is no variation between the driving signals output by the gate driver on array circuit before and after switching, each frame of display image is displayed normally and not influenced by the switching process.

In the gate driver on array circuit provided by the present embodiment, the first gate driver on array sub-circuit stops driving when a defect occurs therein, and the second gate driver on array sub-circuit performs driving When the defect occurs the first gate driver on array sub-circuit, thereby improving the yield rate of the gate driver on array circuit.

Embodiment 3 of the present invention provides a display device comprising a gate driver on array circuit, wherein the gate driver on array circuit may be the gate driver on array circuit provided by the above Embodiment 1 or 2, and descriptions for it will not be repeated here.

In the display device provided by the present embodiment, the first gate driver on array sub-circuit stops driving when a defect occurs therein, and the second gate driver on array sub-circuit performs driving when the defect occurs the first gate driver on array sub-circuit, thereby improving the yield rate of the gate driver on array circuit.

Figure 10:
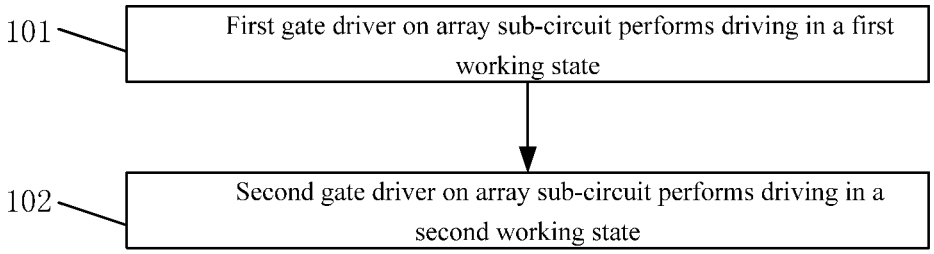
FIG. 10 is a flow chart of a driving method for a gate driver on array circuit provided by Embodiment 4 of the present invention.

FIG. 10 is a flow chart of a driving method for a gate driver on array circuit provided by Embodiment 4 of the present invention. As shown in FIG. 10, the gate driver on array circuit comprises a first gate driver on array sub-circuit and a second gate driver on array sub-circuit, and the method comprises:

Step 101: performing driving in a first working state by the first gate driver on array sub-circuit.

Optionally, the first working state is a state in which no defect occurs in the first gate driver on array sub-circuit, and this step specifically comprises: performing driving the first gate driver on array sub-circuit when no defect occurs therein.

Step 102: performing driving in a second working state the second gate driver on array sub-circuit.

Optionally, the second working state is a state in which a defect occurs in the first gate driver on array sub-circuit, and this step specifically comprises: performing driving by the second gate driver on array sub-circuit when the first gate driver on array sub-circuit stops driving due to occurrence of a defect therein.

The driving method for a gate driver on array circuit provided by the present embodiment may be used for driving the gate driver on array circuit provided by the above Embodiment 1. Descriptions on the gate driver on array circuit may be referred to the above descriptions on Embodiment 1, and will not be repeated here.

In the driving method for a gate driver on array circuit provided by the present embodiment, the first gate driver on array sub-circuit stops driving when a defect occurs therein, and the second gate driver on array sub-circuit performs driving when the defect occurs in the first gate driver on array sub-circuit, thereby improving the yield rate of the gate driver on array circuit.

Figure 11:
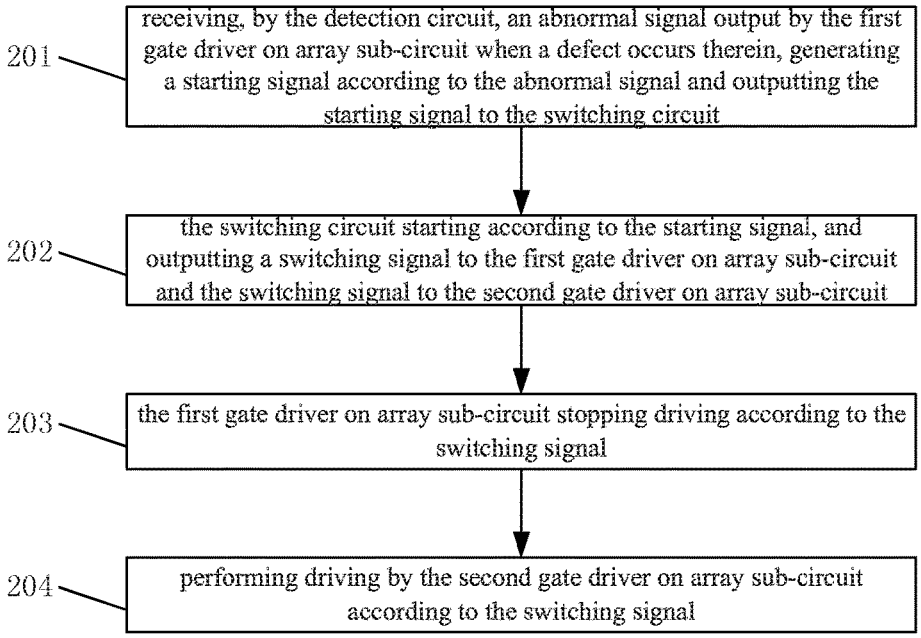
FIG. 11 is a flow chart of a driving method for a gate driver on array circuit provided by Embodiment 5 of the present invention.

FIG. 11 is a flow chart of a driving method for a gate driver on array circuit provided by Embodiment 5 of the present invention. As shown in FIG. 11, the gate driver on array circuit comprises a first gate driver on array sub-circuit, a second gate driver on array sub-circuit, a detection circuit and a switching circuit, and the method comprises:

Step 201: receiving, by the detection circuit, an abnormal signal output by the first gate driver on array sub-circuit when a defect occurs therein, generating a starting signal according to the abnormal signal and outputting the starting signal to the switching circuit;

Step 202: the switching circuit starting according to the starting signal, and outputting a switching signal to the first gate driver on array sub-circuit and the switching signal to the second gate driver on array sub-circuit;

Step 203: first gate driver on array sub-circuit stopping driving according to the switching signal; and Step 204: performing driving by the second gate driver on array sub-circuit according to the switching signal.

The driving method for a gate driver on array circuit provided by the present embodiment may be used for driving the gate driver on array circuit provided by the above Embodiment 2. Descriptions on the gate driver on array circuit may be referred to the above descriptions on Embodiment 2, and will not be repeated here.

In the driving method for a gate driver on array circuit provided by the present embodiment, the first gate driver on array sub-circuit stops driving when a defect occurs therein, and the second gate driver on array sub-circuit performs driving when the defect occurs in the first gate driver on array sub-circuit, thereby improving the yield rate of the gate driver on array circuit.

It will be appreciated that the above embodiments are exemplary implementations for the purpose of illustrating the principle of the present invention only, and the present invention is not limited thereto. It will be apparent to a person skilled in the art that many variations and modifications may be made without departing from the spirit and essence of the present invention. These variations and modifications should also be considered as the protective scope of the present invention.

What is claimed is:

1. A gate driver on array circuit, comprising a first gate driver on array sub-circuit, a second gate driver on array sub-circuit, a detection circuit and a switching circuit;

the first gate driver on array sub-circuit is configured to drive gate lines in a first working state, wherein the first working state is a state in which no defect occurs in the first gate driver on array sub-circuit;

the second gate driver on array sub-circuit is configured to drive the gate lines in a second working state, wherein the second working state is a state in which a defect occurs in the first gate driver on array sub-circuit, wherein the first gate driver on array sub-circuit and the second gate driver on array sub-circuit each include a plurality of cascaded shift registers, output signal terminals of the shift registers in the first gate driver on array sub-circuit are connected to those of respective shift registers in the second gate driver on array sub-circuit, and the output signal terminal of a last row of shift register in the first gate driver on array sub-circuit is connected to an input signal terminal of the detection circuit;

the switching circuit comprises a plurality of cascaded shift registers, an input signal terminal of a first row of shift register of the switching circuit is connected to an output signal terminal of the detection circuit, an output signal terminal of a last row of shift register of the switching circuit is connected to an input signal terminal of a first row of shift register in the second gate driver on array sub-circuit, and the output signal terminal of the last row of shift register of the switching circuit is connected to a switching signal terminal of the first row of shift register in the first gate driver on array sub-circuit.

2. The gate driver on array circuit of claim 1, wherein the first gate driver on array sub-circuit is configured to perform driving when no defect occurs therein and to stop driving when a defect occurs therein;

the second gate driver on array sub-circuit is configured to perform driving when the first gate driver on array sub-circuit stops driving due to occurrence of a defect in the first gate driver on array sub-circuit.

3. The gate driver on array circuit of claim 2, wherein the detection circuit is configured to detect the first gate driver on array sub-circuit and, when a defect occurs in the first gate driver on array sub-circuit, generate an abnormal signal, generate a starting signal according to the abnormal signal and output the starting signal to the switching circuit;

the switching circuit is configured to be started according to the starting signal, and output a switching signal to the first gate driver on array sub-circuit and output the switching signal to the second gate driver on array sub-circuit;

the first gate driver on array sub-circuit is configured to stop driving according to the switching signal;

the second gate driver on array sub-circuit is configured to drive according to the switching signal.

4. The gate driver on array circuit of claim 1, wherein the first gate driver on array sub-circuit is configured to, in the second working state, cause high level signals to be applied to clock signal terminals of the shift registers in the first gate driver on array sub-circuit and low level signals to be applied to other terminals of the shift registers in the first gate driver on array sub-circuit; or the first gate driver on array sub-circuit is configured to, in the second working state, cause clock signals to be applied to the clock signal terminals of the shift registers in the first gate driver on array sub-circuit and low level signals to be applied to other terminals of the shift registers in the first gate driver on array sub-circuit.

5. The gate driver on array circuit of claim 1, wherein each of the shift registers includes a first transistor;

a control electrode of the first transistor is connected to an input signal terminal, a first electrode of the first transistor is connected to a first power supply, and a second electrode of the first transistor is connected to a pull-up node.

6. The gate driver on array circuit of claim 1, wherein a number of rows of the shift registers in the switching circuit is determined according to a blanking time between two frames of display images such that a timing of the switching signal output by the last row of shift register of the switching circuit is the same as that of a frame-start signal of the first row of shift register of the second gate driver on array sub-circuit.

7. The gate driver on array circuit of claim 1, wherein the first row of shift register of the first gate driver on array sub-circuit comprises a switching transistor, a control electrode of the switching transistor is connected to the output signal terminal of the last row of shift register in the switching circuit, a first electrode of the switching transistor is connected to a pull-up node, and a second electrode of the switching transistor is connected to a low level signal terminal.

8. The gate driver on array circuit of claim 1, wherein the detection circuit is an inverter, the abnormal signal is a low level signal, and the starting signal is a high level signal.

9. A display device, comprising the gate driver on array circuit according to claim 1.

10. A driving method for a gate driver on array circuit which comprises a first gate driver on array sub-circuit, a second gate driver on array sub-circuit, a detection circuit and a switching circuit, wherein the first gate driver on array sub-circuit and the second gate driver on array sub-circuit each include a plurality of cascaded shift registers, output signal terminals of the shift registers in the first gate driver on array sub-circuit are connected to those of respective shift registers in the second gate driver on array sub-circuit and the output signal terminal of a last row of shift register in the first gate driver on array sub-circuit is connected to an output signal terminal of the detection circuit;

the switching circuit comprises a plurality of cascaded shift registers, an input signal terminal of a first row of shift register of the switching circuit is connected to an output signal terminal of the detection circuit, an output signal terminal of a last row shift register of the switching circuit is connected to an output signal terminal of a first row of shift register in the second gate driver on array sub-circuit, and the output signal terminal of the last row of shift register of the switching circuit is connected to a switching signal terminal of the first row of shift register in the first gate driver on array sub-circuit;

the method comprises:

driving gate lines in a first working state by the first gate driver on array sub-circuit, wherein the first working state is a state in which no defect occurs in the first gate driver on array sub-circuit; and driving the gate lines in a second working state by the second gate driver on array sub-circuit, wherein the second working state is a state in which a defect occurs in the first gate driver on array sub-circuit, detecting, by the detection circuit, the first gate driver on array sub-circuit and generating an abnormal signal when a defect occurs in the first gate driver on array sub-circuit, generating a starting signal according to the abnormal signal and outputting the starting signal to the switching circuit;

the switching circuit starting according to the starting signal, outputting a switching signal to the first gate driver on array sub-circuit and outputting the switching signal to the second gate driver on array sub-circuit; and the first gate driver on array sub-circuit stopping driving according to the switching signal; and the second gate driver on array sub-circuit performing driving according to the switching signal.

* * * * *